US006354864B1

(12) United States Patent
Kusumoto et al.

(10) Patent No.: US 6,354,864 B1
(45) Date of Patent: Mar. 12, 2002

(54) JOINT TERMINAL AND JOINT CONNECTOR INCLUDING SAID TERMINAL

(75) Inventors: Kuniharu Kusumoto; Yasuo Ito, both of Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 09/692,474

(22) Filed: Oct. 20, 2000

(30) Foreign Application Priority Data

Oct. 22, 1999 (JP) ..... 11-301435

(51) Int. Cl.[7] ..... H01R 4/24
(52) U.S. Cl. ..... 439/404; 429/403; 429/402
(58) Field of Search ..... 439/402, 404, 439/397, 748, 885, 701, 403

(56) References Cited

U.S. PATENT DOCUMENTS

| | | | |
|---|---|---|---|
| 4,975,088 | A | 12/1990 | Brandstäter et al. |
| 5,417,589 | A | 5/1995 | Terada |
| 5,762,517 | A | 6/1998 | Abe |
| 5,908,322 | A | 6/1999 | Seki |

FOREIGN PATENT DOCUMENTS

| | | |
|---|---|---|
| JP | 2102662 | 8/1990 |
| JP | 8306451 | 11/1996 |

OTHER PUBLICATIONS

An English Language abstract of JP 8–306451.

*Primary Examiner*—Tho D. Ta
*Assistant Examiner*—Phuong Nguyen
(74) *Attorney, Agent, or Firm*—Greenblum & Bernstein, P.L.C.

(57) ABSTRACT

A joint connector includes first and second unitary connector assemblies respectively including an insulator plate and a joint terminal fixed thereto. The joint terminal includes unit terminals, each of which includes: a stem portion with first and second faces and side rim portions; a first cramping connector extending from a side rim portion in a direction substantially perpendicular to the first face of the stem portion; and a second cramping connector extending from a third side rim portion in a direction substantially perpendicular to the second face of the stem portion. When the first unitary connector assembly is superposed to the second unitary connector assembly, the second cramping connector of the first unitary connector assembly cramps the second electrical cable, whereby the first electrical cable carried on the first unitary connector assembly can be connected to the second electrical cable carried on the second unitary connector assembly.

20 Claims, 8 Drawing Sheets

JOINT TERMINAL AND JOINT CONNECTOR INCLUDING SAID TERMINAL

FIELD OF THE INVENTION

The present invention relates to joint terminals and a joint connector including such terminals. The invention also concerns a way of establishing connections between the unit terminals which form a joint terminal, and between the joint terminals which form a joint connector. The invention further concerns means for achieving these connections in a flexible way, as a function of the particular type of circuit connection system used.

DESCRIPTION OF BACKGROUND INFORMATION

Joint connectors are sometimes employed for interconnecting the electrical cables which are used in common circuit systems such as grounding lines. FIG. 1 shows a joint connector 1 including a joint connector housing 1*a,* a connecting bus bar 2 adapted for a desired type of connection and inserted into the joint connector housing, and a connector C fitted into the joint connector housing 1*a*. The connector C includes terminals 3 previously bound to corresponding electrical cables D.

The construction of the above joint connector 1 has the drawback of requiring too many component parts. Further, various kinds of connecting bus bars 2 and joint connector housings 1*a* must be available, depending on the type of connector circuit. Moreover, in the above joint connector 1, it is not easy to adapt to the increasing number of connections caused by circuit modifications. In view of the above, a variant joint connector 1' shown in FIG. 2A has been contemplated and disclosed in Japanese patent application published under No. HEI 8-306451. The variant joint connector 1' includes a variant connector housing 1*a*' including terminal enclosures 1*b*', into each of which is inserted a connector terminal 3' such as shown in FIG. 2B.

Such a variant connector housing 1*a*' includes a multistage structure for the terminal enclosures 1*b*' (a four-stage structure is shown in FIG. 2A). Partition walls defining these terminal enclosures 1*b*' have openings for establishing electrical connections in the vertical direction (in FIG. 2A). The front face 1*c*' (left-hand side in FIG. 2A) of the variant connector housing 1*a*' includes a respective insertion orifice 1*d*' corresponding to the position of each terminal enclosure 1*b*'. The connector terminal 3' is provided with a first elastic contact member 3*a*', a second elastic contact member 3*b*' and a connector portion 3*c*', respectively extending on the top, middle and bottom levels of each connector terminal 3' (FIGS. 2A and 2B).

When such connector terminals 3' are inserted into a variant connector housing 1*a*' such as to form a layer, the first elastic contact member 3*a*' of the connector terminal 3' positioned on the lower level is brought into contact with the connector portion 3*c*' of the connector terminal 3' positioned on the upper level. Accordingly, the superposed connector terminals 3' can be connected without applying connecting bus bars 2 as was the case before. Further, a male terminal 4 may be inserted into each terminal enclosure 1*b*' through a corresponding insertion orifice 1*d*' provided in the front face 1*c*' of the variant connector housing 1*a*'. The male terminal 4 can thus be connected to the corresponding second elastic contact member 3*b*' of the connector terminal 3'. Such a configuration makes it easier to respond to the increase of the number of connections to be made.

As mentioned above, the variant joint connector 1' has increased, to a certain degree, the number of connections to be made compared to the joint connector 1. However, in the variant joint connector 1', the number of connections is restricted by the number of terminal enclosures 1*b*' included in the variant connector housing 1*a*'. As a result, a certain range of connector housing products must be prepared in order to respond to the varieties of circuit types. Further, when the connector terminals 3' are superposed, connections are made forcibly, even if all the connections are not needed. As a result, the variant joint connectors 1' cannot be employed in a fully appropriate way.

Further, when mounting a wire harness, sub-harnesses K-1, K-2 and K-3 are first formed by preliminary bundling, as shown in FIG. 3. At this stage, the cable's end portions T-1, T-2 and T-3, which are envisioned to be led out to another sub-harness, are kept unengaged with the connector of any sub-harness, yielding the so-called "yet-to-be connected terminals". These sub-harnesses are then subjected to a main bundling using an assembling design board. Consequently, the "yet-to-be connected" terminals must be inserted into the connectors of other sub-harnesses, while performing the main bundling. Such a mounting process impairs assembly efficiency. Usually, the preliminary bundling and the main bundling for a wire harness W/H are carried out in different workshops. As a result, the unengaged, "yet- to-be connected" terminals T-1, T-2 and T-3 contained in the sub-harnesses K-1, K-2 and K-3 tend to suffer deformation or damage during transfer. Such deformation or damage may render it difficult or unreliable to insert these "yet-to-be connected" terminals into another sub-harness connector in a proper way.

SUMMARY OF THE INVENTION

The present invention has been contemplated to solve such problems. The invention relates to a joint connector in which sub-harnesses contain no "yet-to-be connected" terminal, and which flexibly responds to the increase in the number of electrical cables to be joined and to possible modifications of circuitry. The invention also contemplates providing joint terminals adapted for such a joint connector.

To this end, there is provided a joint terminal including a plurality of unit terminals, each unit terminal including a stem portion in the form of an elongate strip having first and second faces, and first, second and third side rim portions. At least a first cramping connector extends from the first side rim portion in a direction substantially perpendicular to the first face of the stem portion, the first cramping connector including a first cramping blade portion adapted to be connected to the first electrical cable. At least a second cramping connector extends from the second side rim portion in a direction substantially perpendicular to the second face of the stem portion, the second cramping connector including a second cramping blade portion adapted to be connected to a second electrical cable. Additionally, at least one link portion extends from the third side rim portion on substantially the same plane as the stem portion, and wherein the plurality of unit terminals are arranged substantially in parallel relation to one another over the length thereof, and are bound through the at least one link portion.

Preferably, each aforementioned unit terminal further includes at least one cable holder extending from a side rim portion of the stem portion, and adapted for holding a first electrical cable placed on the stem portion.

In another aspect of the present invention, a unitary connector assembly including the above described joint terminal and an insulator plate fixed therewith is provided. The joint terminal is fixed with the insulator plate such that the at least first cramping connector extends from the first side rim portion in a direction substantially perpendicular to the first face of the stem portion, the first cramping connector including a first cramping blade portion adapted to be connected to the first electrical cable. The at least second cramping connector extends from the second side rim portion in a direction substantially perpendicular to the second face of the stem portion, the second cramping connector including a second cramping blade portion adapted to be connected to a second electrical cable. Additionally, the at least one link portion extends from the third side rim portion on substantially the same plane as the stem portion, and the plurality of unit terminals are arranged substantially in parallel relation to one another over the length thereof, and are bound through the aforementioned at least one link portion. The at least first unitary connector assembly is superposed on the at least second unitary connector assembly, so that the second cramping connector of the at least first unitary connector assembly passes through the orifice of the insulator plate and cramps the second electrical cable, whereby the first electrical cable to be carried on the at least first unitary connector assembly can be connected to the second electrical cable to be carried on the at least second unitary connector assembly. Furthermore, the above insulator plate may include an opening at the position corresponding to that of the aforementioned one link portion.

Preferably, the unit terminal further includes at least one cable holder extending from a side rim portion of the stem portion, and adapted for holding a first electrical cable placed on the stem portion.

In a further aspect of the present invention, a joint connector is provided that includes at least first and second unitary connector assemblies respectively including an insulator plate and a joint terminal fixed therewith, the joint terminal including a plurality of unit terminals, each of which includes a stem portion in the form of an elongate strip having first and second faces, and first, second and third side rim portions, at least a first cramping connector, at least a second cramping connector, and at least one link portion. Additionally, the joint terminal may be fixed with the insulator plate such that the at least first cramping connector extends from the first side rim portion in a direction substantially perpendicular to the first face of the stem portion, the first cramping connector including a first cramping blade portion adapted to be connected to the first electrical cable. The at least second cramping connector extends from the second side rim portion in a direction substantially perpendicular to the second face of the stem portion, the second cramping connector including a second cramping blade portion adapted to be connected to a second electrical cable, the at least one link portion extends from third side rim portion on substantially the same plane as the stem, and wherein the plurality of unit terminals are arranged substantially in parallel relation to one another over the length thereof, and are bound through the aforementioned at least one link portion. Furthermore, the at least first unitary connector assembly is superposed on the at least second unitary connector assembly, so that the second cramping connector of the at least first unitary connector assembly cramps the second electrical cable, whereby the first electrical cable to be carried on the at least first unitary connector assembly can be connected to the second electrical cable to be carried on the at least second unitary connector assembly.

Preferably, each unit terminal further includes at least one cable holder extending from a side rim portion of the stem portion, and adapted for holding a first electrical cable placed on the stem portion. Suitably, the joint connector further includes a housing which contains at least first and second unitary connector assemblies.

Further, in the above joint connector, the insulator plate may be provided with an opening at a position corresponding to that of the at least one link portion, such that the opening can receive a cutting tool for cutting the at least one link portion.

Furthermore, in the above joint connector, the stem portion may include first and second pairs of enlarged side portions with a corresponding first or second pair of cramping blades indented therefrom. The first and second cramping connectors are then formed by bending the first and second pairs of enlarged portions, respectively, so that the first pair of cramping blades face each other, while the second pair of cramping blades face each other.

Further yet, the insulator plate may include a rib portion placed adjacent a side of the first or second cramping connector, opposite the side where the pair of cramping blades is mounted, such that the first or second cramping connector is prevented from flexing when the first or second electrical cable is inserted thereinto.

In the above configuration, an end portion of an electrical cable is placed on each stem portion, clamped by the first clamping connector, and may be fixed by the cable holder. As each stem portion is bound to another through a link portion, the clamped electrical cables are electrically connected to one another. When a first joint terminal, with a first electrical cable clamped by a first cramping connector, is superposed on a similarly prepared second joint terminal, a second cramping connector of the first joint terminal clamps an end portion of a second electrical cable clamped by the second joint terminal. In this manner, the electrical cables clamped by the first and the second cramping connector are electrically connected to each other.

When the above joint terminal is to be fixed on an insulator plate, the former may be insert-molded together with the insulator plate. Alternatively, the stem portion of the joint terminal may be provided with a protrusion, while the insulator plate is provided with a corresponding recess, and the stem portion is flanked on a first or a second face of the insulator plate, so that the protrusion and the recess are fitted. In such a construction, at least those end portions of electrical cables of a sub-harness which are envisioned to be connected to those contained in other sub-harnesses are connected to a first unitary connector assembly by clamping. Thereafter, in the main bundling step, the first unitary connector assembly is superposed to a second unitary connector assembly connected to another sub-harness. Accordingly, the electrical cables of different sub-harnesses are connected to one another through the second cramping connector of a corresponding joint terminal. In this manner, the electrical cables, hitherto remaining for later insertion, can be handled in the final form of a sub-harness, by means of making connections with a unitary connector assembly. Further, while the first and second unitary connector assemblies are superposed, some portions thereof may need no connection therebetween, hence there is no need of using the second cramping connector. In such a case, the end portion of an electrical cable may be clamped such that it does not extend beyond the first cramping connector. The connection through the second cramping connector can thus be cut away selectively.

According to another aspect of the present invention, the housing may include a guide, through which the superposed unitary connector assemblies are positioned and inserted into the housing. Preferably, the housing further includes a locking device, by which the unitary connector assemblies are fixed in the housing, once they are completely inserted therein. The unitary connector assemblies are thus held together, after they have been superposed and the necessary connections have been made therebetween. The mounted unitary connector assemblies can the can be easily fixed at a desire position in a wire harness.

When a connection in a same unitary connector assembly is not needed between the adjacent electrical cables held by the corresponding first cramping connectors, the link portion in the joint terminal is cut out through the opening by using a cutting tool. Various kinds of new circuit settings can thus be responded to very quickly. Further, an electrical cable may be clamped to a joint terminal with unnecessary link portions cut off, before the joint terminal has been fixed to an insulator plate by insert-molding or the like. Unnecessary work steps at the level of the joint terminals can thus be avoided.

Suitably, the height of a rib portion is designed so as to define an available space when the unitary connector assemblies are superposed. By defining this height, a deflection of the cramping blade portion can be avoided, and the cramping connections are made more reliably when the end portions of the cable are clamped by the cramping connectors. Further, when the unitary connector assemblies are superposed and the electrical cables of the superposed unitary connector assemblies are fixed by the cramping connectors, the rib portion can be used as a stopper for regulating the vertical movement.

BRIEF DESCRIPTION OF THE DRAWINGS

The above and the other objects, features and advantages of the present invention will be made apparent from the following description of the preferred embodiments, given as non-limiting examples, with reference to the accompanying drawings, in which.

DETAILED DESCRIPTION OF THE PREFERRED EMBODIMENTS

Figure 1:
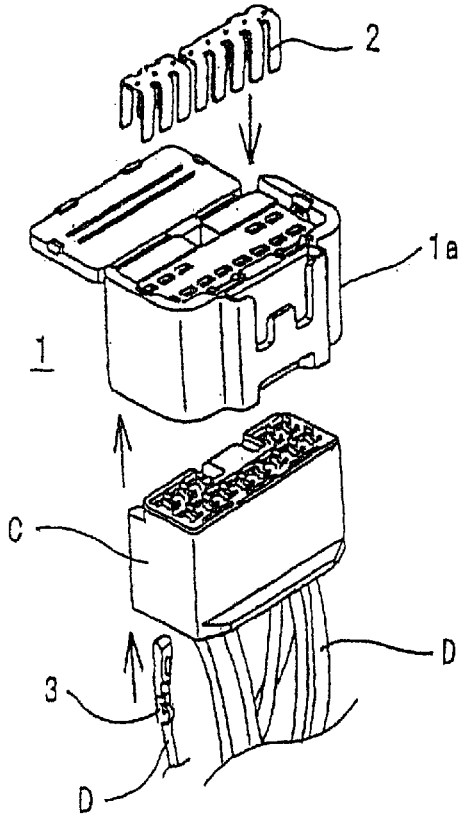
FIG.1 PRIOR ART
FIG. 1 is a perspective view of a known joint connector when it is being mounted.
Figure 2A:
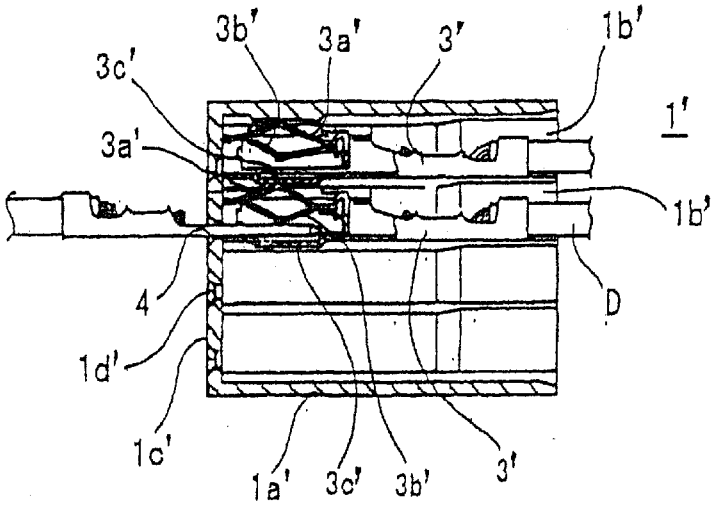
FIG.2A PRIOR ART
FIG. 2A is a cross-sectional side view of another known joint connector.
Figure 2B:
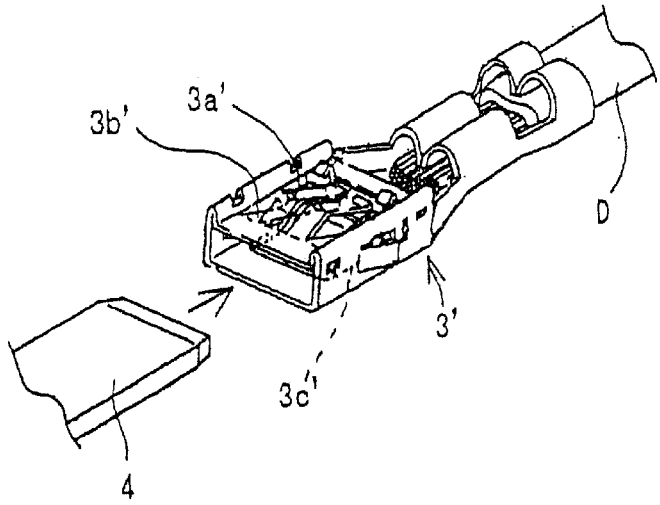
FIG.2B PRIOR ART
FIG. 2B is a perspective view of a terminal used in the joint connector of FIG. 2A.
Figure 3:
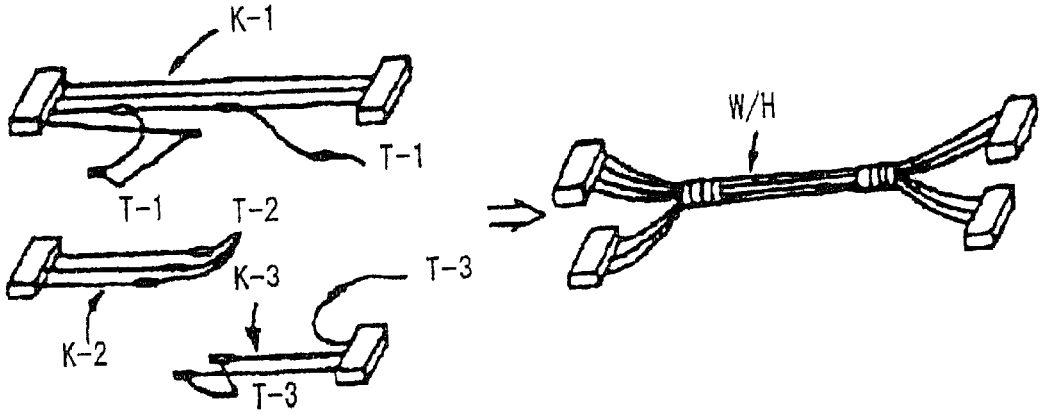
FIG.3 PRIOR ART
FIG. 3 is a schematic diagram showing a known construction of preliminarily bundled sub-harnesses and a bundled wire harness.
Figure 4:
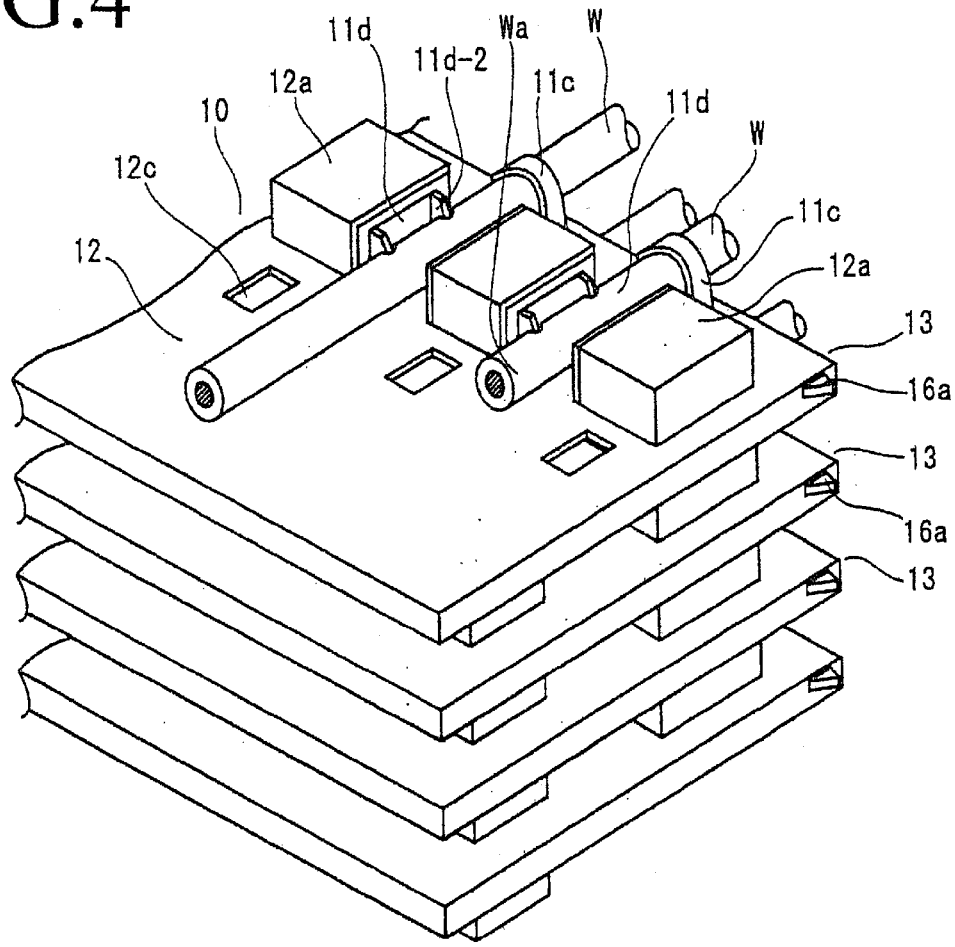
FIG. 4 is a perspective view of a joint connector according to the invention.

FIG. 4 shows a joint connector 10 according to one aspect of the present invention. A joint terminal 11 is connected to end portions of corresponding electrical cables W, and fixed on a substantially flat insulator plate 12, thereby forming a unitary connector assembly 13. A joint connector 10 is formed by superposing a plurality of such unitary connector assemblies 13. In this manner, the electrical cables W mounted in a single unitary connector assembly 13 can be electrically connected to one another, while those mounted in different unitary connector assemblies 13 can also be electrically connected to one another.

Figure 5:
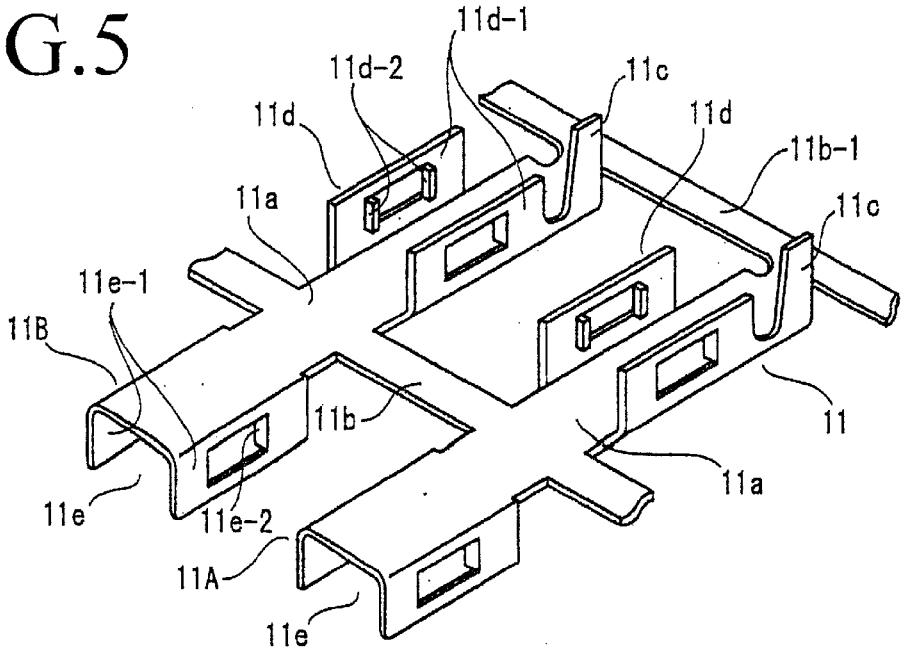
FIG. 5 is a perspective view of a joint terminal according to the invention.

FIG. 5 shows a joint terminal 11 formed by folding a metal plate stamped out in a given shape. In the joint terminal 11, a plurality of unit terminals 11A, 11B, etc., which respectively include a stem portion 11*a* having an elongate shape, are arranged in parallel. The stem portions 11*a* of each unit terminal 11A, 11B, etc. are bound to one another through a middle link 11*b* located at a substantially central point over the length of each stem portion 11*a,* so as to yield a necessary number of unit terminals to be connected. A portion adjacent a first end of the stein portion 11*a* (right-hand upper side in FIG. 5) may be provided with a cable holder 11*c* which extends therefrom and may form a barrel shape when in use. Each cable holder 11*c* press-fixes the end portion of an electrical cable W received on the stem portion 11*a*.

There is also provided a first cramping connector 11*d* located farther from the first end of the stem portion 11*a* and adjacent the cable holder 11*c*. It is noted that such cramping connectors are also known as insulation displacement connectors in the art. The first cramping connector 11*d* includes a pair of first sidewalls 11*d*-1 formed by upwardly bending a pair of enlarged side portions of the stem portion 11*a*. Further, each of the first sidewalls 11*d*-1 includes a pair of first cramping blades 11*d*-2 extending therefrom towards the corresponding first cramping blades 11*d*-2 of the opposing first side-wall 11*d*-1. Such cramping blades are also known as insulation displacement blades in the art. Likewise, a second end of the stem portion 11*a* (left-hand lower side in FIG. 5) is provided with a pair of second sidewalls 11*e*-1 with a respective pair of second cramping blades 11*e*-2, thereby forming a second cramping connector 11*e*. However, the second cramping connector 11*e* is formed such as to extend opposite to the direction of the first cramping connector 11*d*. The second cramping connector 11*e* can thus serve for cramping an electrical cable W connected to another joint terminal 11. When establishing the mechanical and electrical links between unit terminals 11A, 11B, etc., the means used are not limited to the above-mentioned middle link 11*b*. An end link 11*b*-1, which has been used as a manufacturing conveyer when the unit terminals were made, can also be used appropriately. However, the middle link 11*b* is better suited for miniaturizing the joint terminal 11. When such is the case, the end link 11*b*-1 is cut away after a joint terminal 11 has been formed.

The joint terminal 11 thus manufactured is then fixed on an insulator plate, thereby forming a unitary connector assembly 13. To this end, among the electrical cables included in a sub-harness, at least those which are to be connected to the electrical cables W in other sub-harness are first selected. Those selected electrical cables W are then cramped by the first cramping connector 11*d* of the joint terminal 11*d* of the joint terminal 11, such that the latter is brought into contact with a core wire Wb contained in an electrical cable W (see FIG. 7). In addition, the electrical cable W is cramped such that an end portion thereof is laid at a position of stem portion 11*a* which corresponds to the rear side of the second cramping connector 11*e* which is located near the second end of the stem portion 11*a*. If the unit terminals 11A, 11B, etc. are to be electrically shut, the middle link 11*b* is cut out beforehand. A plurality of unitary connector assemblies 13 are then superposed so that electrical cables W are connected in the vertical direction too. When a connection is not needed, the electrical cable W concerned is not extended to the back of the second cramping connector 11*e,* while the same electrical cable W is cramped by the first cramping connector 11*d.*

Figure 6A:
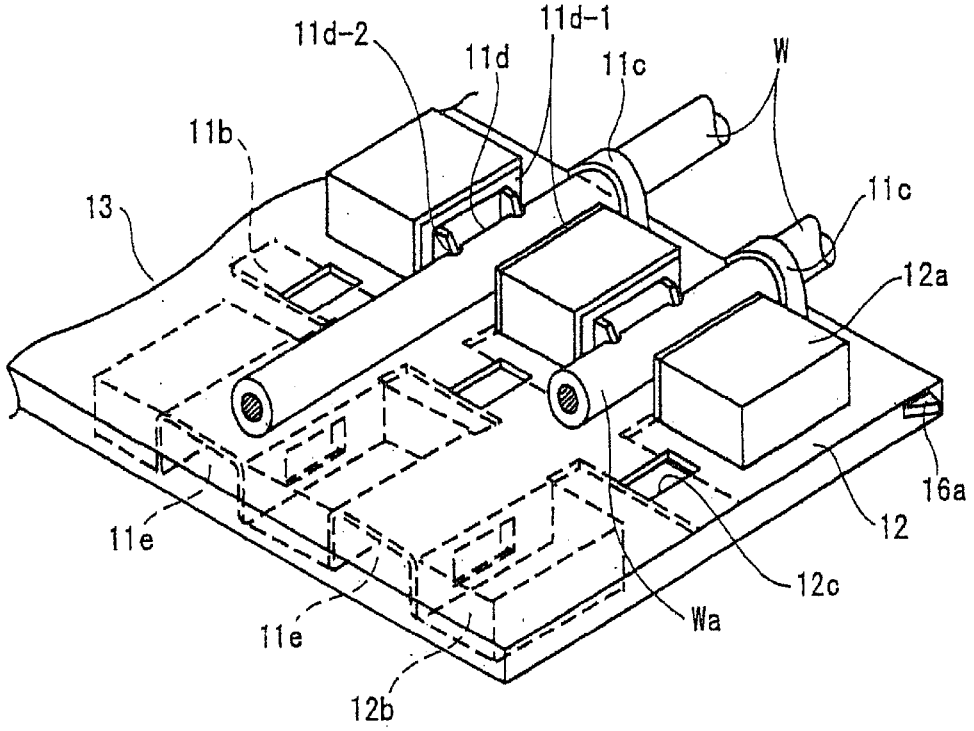
FIG. 6A is a perspective, upper-side view of a unitary connector assembly of the invention, when it is connected with electrical cables.
Figure 6B:
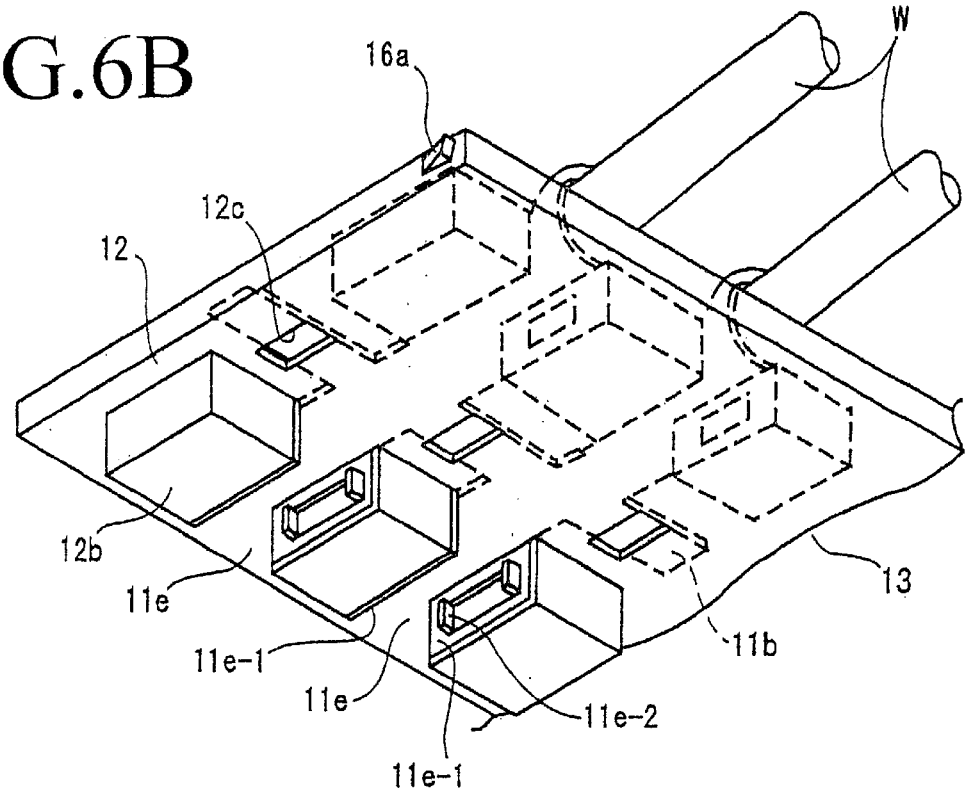
FIG. 6B is a perspective, under-side view of the unitary connector assembly of the assembly.
Figure 7:
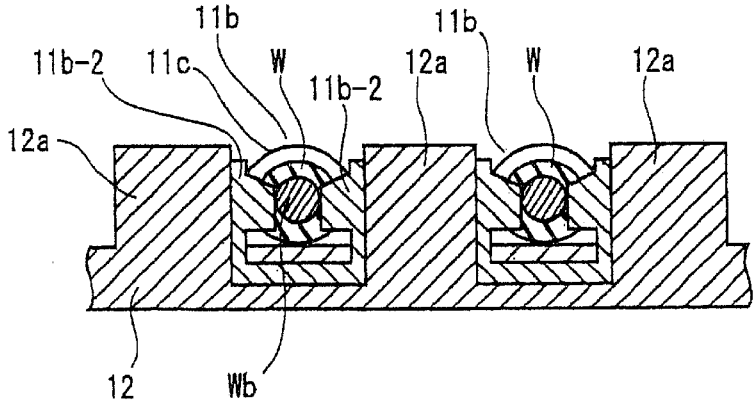
FIG. 7 is a cross-sectional view of a first cramping connector of the invention.

As can be understood from FIGS. 6 and 7, the joint terminal 11 connected to an electrical cable W through a cramping connector may be insert-molded, together with an insulator plate 12. The joint terminal 11 fixed on a first surface of the insulator plate 12 may thus include a first cramping connector 11*d* and a cable holder 11*c* respectively projecting upwardly from the first surface, as well as a second cramping connector 11*e* projecting downwardly from a second surface of the insulator plate 12. The first surface of the insulator 12 may be provided with a first rib portion 12*a* between the first cramping connectors 11*d* of respective unit terminals 11A, 11B, etc." Likewise, the second surface thereof is provided with a second rib portion 12*b* between the second cramping connectors 11*e* of respective unit terminals 11A, 11B, etc. The first and second rib portions 12*a* and 12*b* may be formed integrally with the insulator plate 12, and prevent the flexion of corresponding cramping blades 11*d*-2 and 11*e*-2 when they cramping an electrical cable W. These rib portions 12*a* and 12*b* have a height slightly greater than that of the first and the second cramping connectors 11*d* and 11*e* such that, when unitary connector assemblies 13 are superposed, the rib portions 12*a* and 12*b* define an available space and protect the first and the second cramping connectors 11*d* and 11*e*.

Figure 8A:
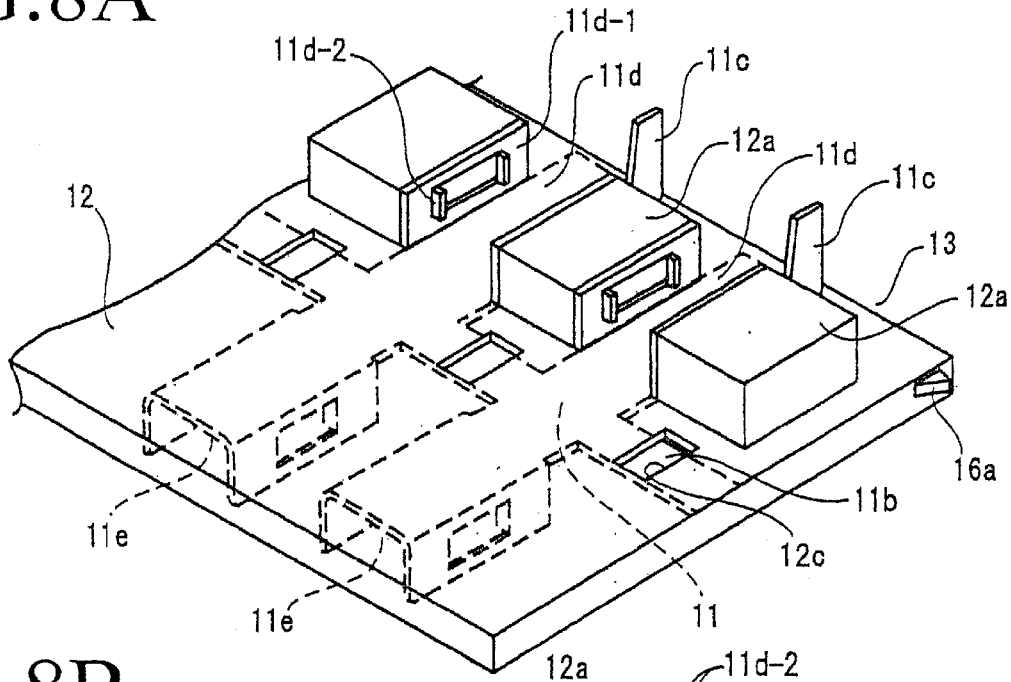
FIG. 8A is a perspective view of a unitary connector assembly of the invention.
Figure 8B:
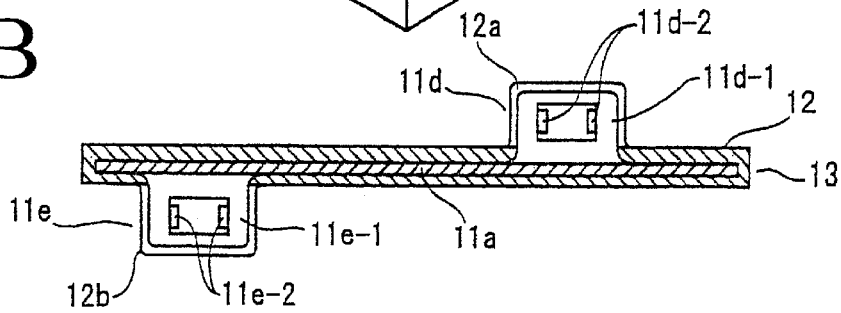
FIG. 8B is a cross-sectional view of the unitary connector assembly of FIG. 8A.

Alternatively, as shown in FIGS. 8A and 8B, a joint terminal 11, unconnected to electrical cables W, may be insert-molded together with an insulator plate 12.

Figure 9:
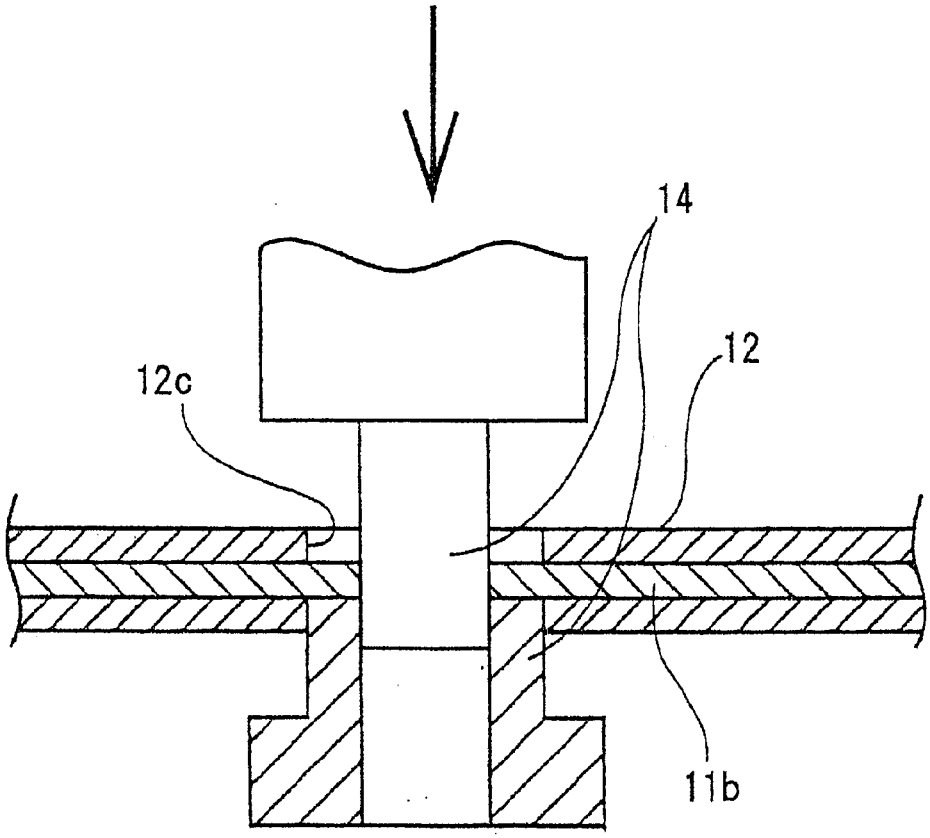
FIG. 9 is a cross-sectional enlarged view when a middle link is cut away.

Moreover, an orifice 12*c* may be provided in the insulator plate 12, at a position corresponding to that of the middle link 11*b* bridging the stem portions 11*a* of each unit terminal 11A, 11B, etc.. As shown in FIG. 9, this orifice 12*c* serves for inserting a cutting tool 14 which cuts away the middle link 11*b*. The cutting tool 14 thus can shut the electrical connection between the adjacent unit terminals 11A, 11B, and the like, by cutting off a desired middle link 11*b*.

Figure 10A:
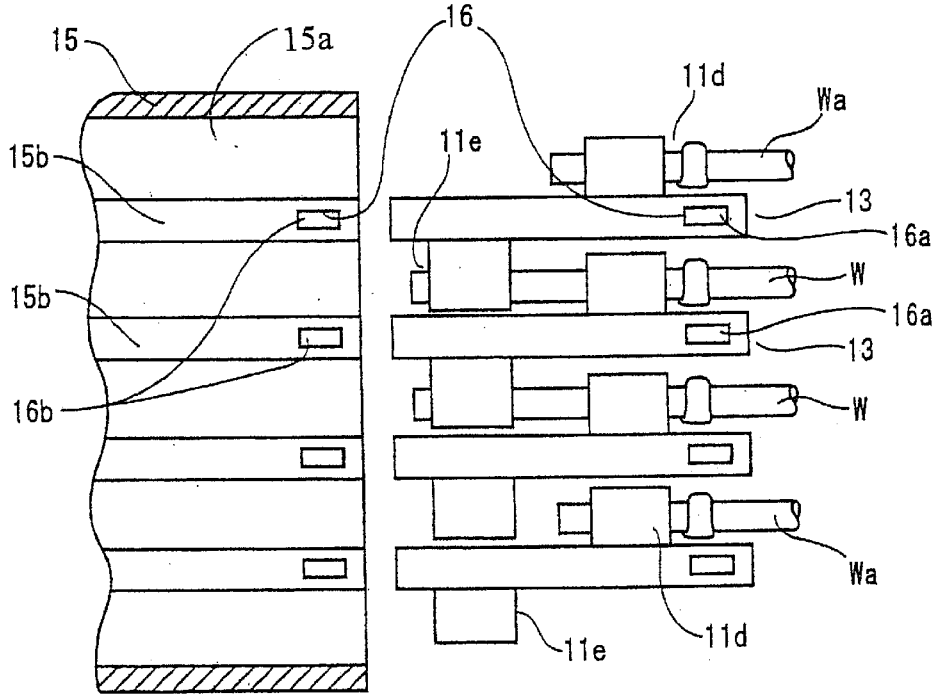
FIG. 10A is a side view when a joint connector is carried into a housing.

In the manner described above, the sub-harnesses can take a final form which contains no "yet-to-be connected" terminals. Such sub-harnesses are subjected to a main bundling process on an assembly board. In this process, as shown in FIGS. 4 and 10A, the unitary connector assemblies 13 attached to the end portions of the cables of each sub-harnesses are superposed. To this end, the unitary connector assemblies 13 are arranged vertically, and pushed from above by an assembly tool. In this manner, a first electrical cable W extending from the first cramping connector 11*d* in a first unitary connector assembly 13 is clamped by the cramping blades 11*e*-2 of the second cramping connector 11*e* in a second unitary connector assembly 13, so that the superposed unitary connector assemblies 13 are electrically connected through their electrical cables W. In this case, a second electrical cable Wa staying at the position of the first cramping connector 11*d* in the first unitary connector assembly 13 is not caught by the second cramping connector 11*e* in the second unitary connector assembly 13, so that electrical connections are not established between the superposed unitary connector assemblies 13.

Figure 10B:
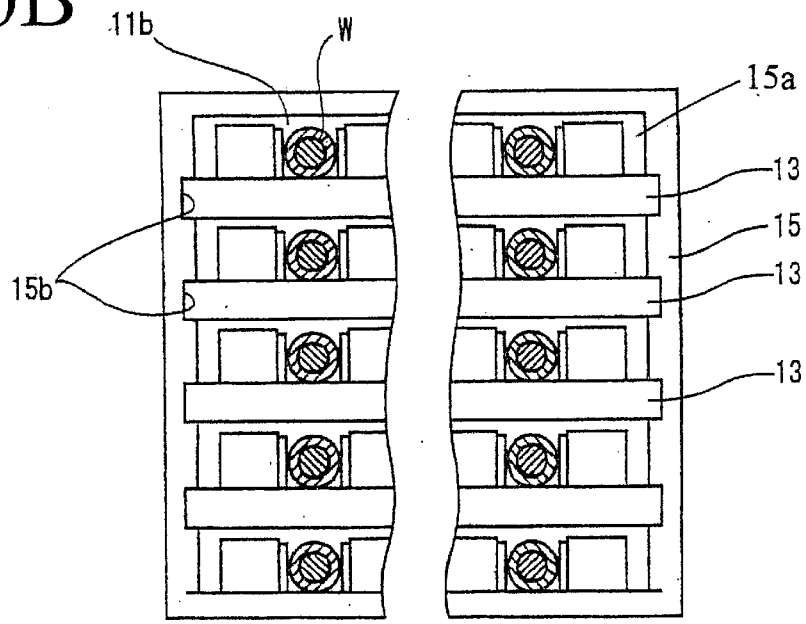
FIG. 10B is a front view when the joint connector of FIG. 10A is stored in the housing.

As shown in FIGS. 10A and 10B, the superposed unitary connector assemblies 13 may be contained, for example, in a housing 15. The housing 15 may include, for example, a plurality of enclosures 15*a,* each of which can contain a unitary connector assembly 13. The housing 15 may also include a guide 15*b* formed into a groove, through which both side rims of an insulator plate 12 are carried into an enclosure 15*a*. Further, each unitary connector assembly 13 may be fixed in the housing 15 by a locking device 16. The locking device 16 includes a protrusion 16*a* provided on each side face of the insulator plate 12, and a corresponding recess 16*b* provided on the guide 15*b*.

Figure 11:
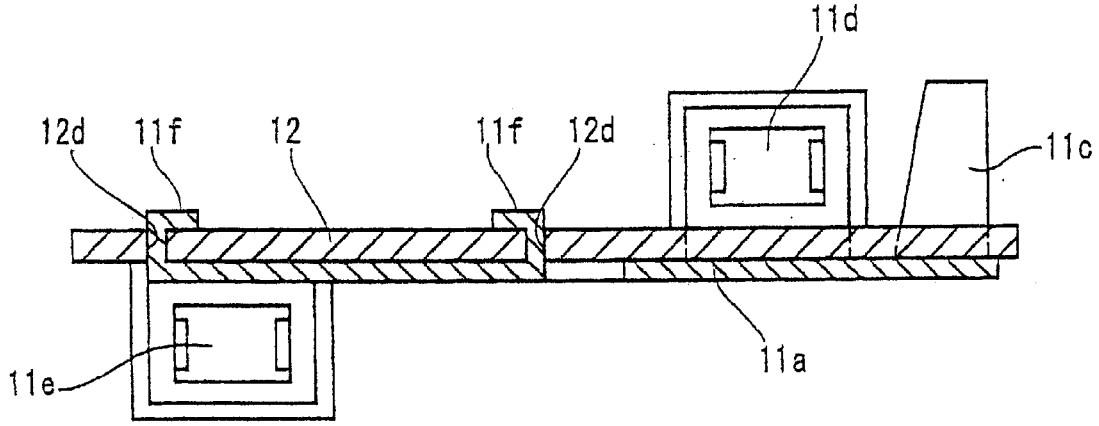
FIG. 11 is a cross-sectional view of a variant fixture in which a joint terminal is fixed to an insulator plate.

In the above embodiment, the joint terminal 11 is fixed onto the insulator plate 12 by insert-molding. FIG. 11 shows another embodiment, in which the stem portion 11*a* of joint terminal 11 is provided with a stud 11*f,* while the insulator plate 12 is provided with a corresponding stud hole 12*d.* The stem portion 11*a* is then flanked along a surface of the insulator plate 12, and fixed thereto by the stud and stud hole.

According to the present invention, when sub-harnesses are to be mounted, at least those electrical cables hitherto left over for later connections are arranged into a joint terminal in a joint terminal connector assembly. When such unitary connector assemblies are superposed on each other in the main bundling process, the electrical cables are electrically connected to those of other sub-harnesses through a corresponding joint terminal. Accordingly, the sub-harness no longer contain left-over, "yet-to-be connected" terminals.

Handling steps and the time required for fixing such terminals are thus reduced, so that wire harness can be mounted more efficiently. Further, damage to the terminals, which often occurs during the transfer of sub-harnesses, can be avoided, so that the wire harness acquires a better quality and is rendered more reliable. Furthermore, the joint terminal of the invention can easily respond to changes of the circuits to be joined.

Alternatively, electrical cables may be first clamped to a joint terminal, unnecessary unit terminals forming such a joint terminal may be cut off, and the joint terminal is fixed on an insulator plate or board. The joint terminal can thus be configured rationally and economically.

Although the invention has been described with reference to particular means, materials and embodiments, it is to be understood that the invention is not limited to the particulars disclosed and extends to all equivalents within the scope of the claims.

The present disclosure relates to subject matter contained in priority Japanese Application No. HEI 11-301435, filed on Oct. 22, 1999, which is herein expressly incorporated by reference in its entirely.

What is claimed is:

1. A joint terminal comprising a plurality of unit terminals, each unit terminal including:

a stem portion in the form of an elongate strip having first and second opposite faces, and first and second opposite side rims having first, second and third side rim portions there along;

at least a first insulation displacement connector extending from said first side rim portion in a direction substantially perpendicular to said first face of said stem portion, said first insulation displacement connector including a first insulation displacement blade portion adapted to be connected to a first electrical cable;

at least a second insulation displacement connector extending from said second side rim portion in a direction substantially perpendicular to said second face of said stem portion and opposite to said first insulation displacement connector, said second insulation displacement connector including a second insulation displacement blade portion adapted to be connected to a second electrical cable; and at least one link portion extending from said third side rim portion in substantially the same plane as said stem portion;

wherein said plurality of unit terminals are arranged substantially in parallel relation to one another over the length thereof, and connected through said at least one link portion.

2. The joint terminal according to claim 1, wherein each said unit terminal further includes at least one cable holder extending from a side rim portion of said stem portion, and adapted for holding the first electrical cable placed on said stem portion.

3. A unitary connector assembly comprising an insulator plate and a joint terminal fixed therewith, said joint terminal comprising a plurality of unit terminals, each unit terminal including:

a stem portion in the form of an elongate strip having first and second opposite faces, and first and second opposite side rims having first, second and third side rim portions there along;

at least a first insulation displacement connector;

at least a second insulation displacement connector; and at least one link portion;

said joint terminal being fixed with said insulator plate such that:

said first insulation displacement connector extends from said first side rim portion in a direction substantially perpendicular to said first face of said stem portion, said first insulation displacement connector including a first insulation displacement blade portion adapted to be connected to a first electrical cable;

said second insulation displacement connector extends from said second side rim portion in a direction substantially perpendicular to said second face of said stem portion and opposite to said first insulation displacement connector, said second insulation displacement connector including a second insulation displacement blade portion adapted to be connected to a second electrical cable; and said at least one link portion extends from said third side rim portion in substantially the same plane as said stem portion;

wherein said plurality of unit terminals are arranged substantially in parallel relation to one another over the length thereof, and connected through said at least one link portion; and said insulator plate comprising an opening at a position corresponding to that of said at least one link portion.

4. The unitary connector assembly according to claim 3, wherein each said unit terminal further includes at least one cable holder extending from a side rim portion of said stem portion, and adapted for holding the first electrical cable placed on said stem portion.

5. A joint connector comprising at least first and second unitary connector assemblies each respectively including an insulator plate and a joint terminal fixed therewith, said joint terminal comprising a plurality of unit terminals, each unit terminal including:

a stem portion in the form of an elongate strip having first and second opposite faces, and first and second opposite side rims having first, second and third side rim portions there along;

at least a first insulation displacement connector;

at least a second insulation displacement connector; and at least one link portion;

said joint terminal being fixed with said insulator plate such that:

said first insulation displacement connector extends from said first side rim portion in a direction substantially perpendicular to said first face of said stem portion, said first insulation displacement connector including a first insulation displacement blade portion adapted to be connected to a first electrical cable;

said second insulation displacement connector extends from said second side rim portion in a direction substantially perpendicular to said second face of said stem portion and opposite to said first insulation displacement connector, said second insulation displacement connector including a second insulation displacement blade portion adapted to be connected to a second electrical cable; and said at least one link portion extends from said third side rim portion in substantially the same plane as said stem portion;

wherein said plurality of unit terminals are arranged substantially in parallel relation to one another over the length thereof, and connected through said at least one link portion; and said first unitary connector assembly being superposed on said second unitary connector assembly, so that said second insulation displacement connector of said first unitary connector assembly passes through an orifice of said insulator plate and engages the second electrical cable;

whereby the first electrical cable to be carried on said first unitary connector assembly can be connected to the second electrical cable to be carried on said second unitary connector assembly.

6. The joint connector according to claim 5, wherein said stem portion includes first and second pairs of enlarged side portions with corresponding first and second pairs of insulation displacement blades indented therefrom, and said first and second insulation displacement connectors are formed by bending said first and second pairs of enlarged portions, respectively, so that said first pair of insulation displacement blades face each other, and said second pair of insulation displacement blades face each other.

7. The joint connector according to claim 5, wherein said insulator plate comprises a rib portion positioned adjacent a side of one of said first and second insulation displacement connectors, opposite to the side where said pair of insulation displacement blades is mounted, such that said one of said first and second insulation displacement connectors is prevented from flexing when one of the first and second electrical cables is inserted thereinto.

8. The joint connector according to claim 5, further comprising a housing which contains said at least first and second unitary connector assemblies.

9. The joint connector according to claim 8, wherein said insulator plate is provided with an opening at a position corresponding to that of said at least one link portion, such that said opening can receive a cutting tool for cutting said at least one link portion.

10. The joint connector according to claim 5, wherein said insulator plate is provided with an opening at a position corresponding to that of said at least one link portion, such that said opening can receive a cutting tool for cutting said at least one link portion.

11. The joint connector according to claim 10, wherein said stem portion includes first and second pairs of enlarged side portions with corresponding first and second pairs of insulation displacement blades indented therefrom, and said first and second insulation displacement connectors are formed by bending said first and second pairs of enlarged portions, respectively, so that said first pair of insulation displacement blades face each other, and said second pair of insulation displacement blades face each other.

12. The joint connector according to claim 10, wherein said insulator plate comprises a rib portion positioned adjacent a side of one of said first and second insulation displacement connectors, opposite to the side where said pair of insulation displacement blades is mounted, such that said one of said first and second insulation displacement connectors is prevented from flexing when one of the first and second electrical cables is inserted thereinto.

13. The joint connector according to claim 5, wherein each said unit terminal further includes at least one cable holder extending from a side rim portion of said stem portion, and being adapted for holding the first electrical cable placed on said stem portion.

14. The joint connector according to claim 13, wherein said stem portion includes first and second pairs of enlarged side portions with corresponding first and second pairs of insulation displacement blades indented therefrom, and said first and second insulation displacement connectors are formed by bending said first and second pairs of enlarged portions, respectively, so that said first pair of insulation displacement blades face each other, and said second pair of insulation displacement blades face each other.

15. The joint connector according to claim 13, wherein said insulator plate comprises a rib portion positioned adjacent a side of one of said first and second insulation displacement connectors, opposite to the side where said pair of insulation displacement blades is mounted, such that said one of said first and second insulation displacement connectors is prevented from flexing when one of the first and second electrical cables is inserted thereinto.

16. The joint connector according to claim 13, wherein said insulator plate is provided with an opening at a position corresponding to that of said at least one link portion, such that said opening can receive a cutting tool for cutting said at least one link portion.

17. The joint connector according to claim 16, wherein said stem portion includes first and second pairs of enlarged side portions with corresponding first and second pairs of insulation displacement blades indented therefrom, and said first and second insulation displacement connectors are formed by bending said first and second pairs of enlarged portions, respectively, so that said first pair of insulation displacement blades face each other, and said second pair of insulation displacement blades face each other.

18. The joint connector according to claim 16, wherein said insulator plate comprises a rib portion positioned adjacent a side of one of said first and second insulation displacement connectors, opposite to the side where said pair of insulation displacement blades is mounted, such that said one of said first and second insulation displacement connectors is prevented from flexing when one of the first and second electrical cables is inserted thereinto.

19. The joint connector according to claim 13, further comprising a housing which contains said at least first and second unitary connector assemblies.

20. The joint connector according to claim 19, wherein said insulator plate is provided with an opening at a position corresponding to that of said at least one link portion, such that said opening can receive a cutting tool for cutting said at least one link portion.

* * * * *

UNITED STATES PATENT AND TRADEMARK OFFICE

CERTIFICATE OF CORRECTION

PATENT NO. : 6,354,864 B1
DATED : March 12, 2002
INVENTOR(S) : K. Kusumoto et al.

It is certified that error appears in the above-identified patent and that said Letters Patent is hereby corrected as shown below:

Title page,
Item [56], References Cited, the following U.S. PATENT DOCUMENTS were omitted and should be included:

| | | | |
|---|---|---|---|
| -- | 6,077,103A | 6/2000 | Saka et al. |
| | 6,007,367A | 12/1999 | Gehebauer et a1. |
| | 5,924,900A | 7/1999 | Davis et al. |
| | 5,520,550A | 5/1996 | Okabe |
| | 4,973,261A | 11/1990 | Hatagishi et al. |
| | 5,554,040A | 9/1996 | Sugiura et al. |
| | 6,109,982A | 8/2000 | Okabe et al. |
| | 6,007,366A | 12/1999 | Torii et al. |
| | 5,769,654A | 6/1998 | Onoda |
| | 5,921,804A | 7/1999 | Nagai -- |

Signed and Sealed this

Thirtieth Day of September, 2003

JAMES E. ROGAN
*Director of the United States Patent and Trademark Office*